US008928537B2

(12) United States Patent
Kerselaers

(10) Patent No.: US 8,928,537 B2
(45) Date of Patent: Jan. 6, 2015

(54) MULTIBAND ANTENNA

(75) Inventor: Anthony Kerselaers, Herselt (BE)

(73) Assignee: NXP, B.V., Eindhoven (NL)

( * ) Notice: Subject to any disclaimer, the term of this patent is extended or adjusted under 35 U.S.C. 154(b) by 165 days.

(21) Appl. No.: 13/407,463
(22) Filed: Feb. 28, 2012

(65) Prior Publication Data

US 2012/0223864 A1 Sep. 6, 2012

(30) Foreign Application Priority Data

Mar. 3, 2011 (EP) ..... 11250243

(51) Int. Cl.

| | |
|---|---|
| ***H01Q 1/32*** | (2006.01) |
| ***H01Q 1/38*** | (2006.01) |
| ***H01Q 1/48*** | (2006.01) |
| ***H01Q 5/00*** | (2006.01) |
| ***H01Q 9/42*** | (2006.01) |
| ***H01Q 13/10*** | (2006.01) |
| ***H01Q 13/16*** | (2006.01) |

(52) U.S. Cl.
CPC ..... *H01Q 1/3275* (2013.01); *H01Q 1/38* (2013.01); *H01Q 1/48* (2013.01); *H01Q 5/0055* (2013.01); *H01Q 9/42* (2013.01); *H01Q 13/106* (2013.01); *H01Q 13/16* (2013.01)
USPC ..... 343/713; 343/700 MS

(58) Field of Classification Search
CPC ..... H01Q 3/44; H01Q 1/3275; H01Q 1/1271
USPC ..... 343/700 MS, 711, 713
See application file for complete search history.

(56) References Cited

U.S. PATENT DOCUMENTS

| | | | | |
|---|---|---|---|---|
| 5,754,145 | A | 5/1998 | Evans | |
| 6,741,214 | B1 * | 5/2004 | Kadambi et al. | 343/700 MS |
| 7,375,687 | B2 * | 5/2008 | Ke et al. | 343/700 MS |
| 7,612,720 | B2 | 11/2009 | Kerselaers | |

(Continued)

FOREIGN PATENT DOCUMENTS

| | | | | |
|---|---|---|---|---|
| CN | 101931128 | A | 12/2010 | |
| CN | 201682057 | U | 12/2010 | |
| DE | 10 2005 054 286 | A1 | 5/2007 | |
| DE | 10 2007 055 327 | A1 | 6/2009 | |
| DE | 10 2008 043 242 | A1 | 4/2010 | |
| EP | 1 294 049 | A1 | 3/2003 | |
| EP | 1 414 109 | A2 | 4/2004 | |
| EP | 2 204 880 | A1 | 7/2010 | |
| EP | 2 256 859 | A1 | 12/2010 | |
| WO | WO2010049435 | * | 5/2010 | H01Q 1/38 |

OTHER PUBLICATIONS

Rosu, I. "PIFA—Planar Inverted F Antenna", YO3DAC/VA3IUL, retrieved from the Internet on Feb. 3, 2011 at http://www.qsl.net/va3iul/Antenna/PIFA/PIFA_Planar_Inverted_F_Antenna.pdf, 4 pgs.

Extended European Search Report for European Patent Appln. No. 11250243.0 (Aug. 16, 2011).

Office Action from counterpart application CN201210048372.2 (Nov. 21, 2013).

*Primary Examiner* — Hoanganh Le

(57) ABSTRACT

A multiband antenna (200) comprising a substrate (202) and at least one conductive plate (204) on the substrate (202). The at least one conductive plate (204) defines a first conductive region (206), a second conductive region (208) and a third conductive region (210). The first, second and third conductive regions (206, 208, 210) are configured so as to define a first gap (212) between the first conductive region (206) and the second conductive region (208); and a second gap (214) between the second conductive region (208) and the third conductive region (210). The multiband antenna also comprises a feeding port (230) comprising a signal terminal (230*a*). The signal terminal (230*a*) is configured to couple the second conductive region (208) to a first connecting element for conducting transmit or receive signals.

20 Claims, 7 Drawing Sheets

(56) References Cited

U.S. PATENT DOCUMENTS

| | | | | |
|---|---|---|---|---|
| 8,150,333 | B2 | 4/2012 | Lin et al. | |
| 2003/0076268 | A1* | 4/2003 | Tarvas et al. | 343/702 |
| 2004/0021605 | A1 | 2/2004 | Kouam et al. | |
| 2004/0085244 | A1* | 5/2004 | Kadambi et al. | 343/700 MS |
| 2004/0135729 | A1 | 7/2004 | Talvitie et al. | |
| 2004/0150567 | A1* | 8/2004 | Yuanzhu | 343/700 MS |
| 2007/0132641 | A1* | 6/2007 | Korva et al. | 343/700 MS |
| 2008/0001824 | A1 | 1/2008 | Castaneda et al. | |
| 2009/0135071 | A1* | 5/2009 | Huang et al. | 343/700 MS |
| 2009/0262028 | A1* | 10/2009 | Mumbru et al. | 343/702 |
| 2010/0182202 | A1 | 7/2010 | Shih | |
| 2012/0146853 | A1* | 6/2012 | Chang et al. | 343/700 MS |

* cited by examiner

MULTIBAND ANTENNA

CROSS-REFERENCE TO RELATED APPLICATIONS

This application claims the priority under 35 U.S.C. §119 of European patent application no. 11250243.0, filed on Mar. 3, 2011, the contents of which are incorporated by reference herein.

The present disclosure relates to the field of multiband antennas, in particular, although not exclusively, to a compact multiband antenna for transmitting signals from, and receiving signals at, an automobile in a plurality of frequency bands.

Today's vehicles are equipped with many wireless devices so as to receive radio and television broadcasts, for cellular telecommunications and GPS signals for navigation. In the future, even more communication systems will be implemented for "intelligent driving" such as dedicated short range communication (DSRC). As a result, the number of automotive antennas is increasing and miniaturization requirements are becoming an important consideration for reducing the unit cost price of the antenna systems. The largest cost is the cabling between the antennas and the respective electronic devices; typically this cabling costs five Euro per coaxial cable.

Multiple antennas are often concentrated in one antenna unit, called a "shark fin" unit. A shark fin unit may be positioned on the back of the roof top of a car.

The listing or discussion of a prior-published document or any background in the specification should not necessarily be taken as an acknowledgement that the document or background is part of the state of the art or is common general knowledge.

According to a first aspect of the invention, there is provided a multiband antenna comprising:

- a substrate;
- at least one conductive plate on the substrate that defines a first conductive region, a second conductive region and a third conductive region;
- wherein the first, second and third conductive regions are configured so as to define:
  - a first gap between the first conductive region and the second conductive region; and
  - a second gap between the second conductive region and the third conductive region, and
- a feeding port comprising a signal terminal, wherein the signal terminal is configured to couple the second conductive region to a first connecting element for conducting transmit or receive signals.

The multiband antenna can provide a compact and low cost implementation of a multiband antenna that can adequately operate at frequencies in the region of 0.5 GHz to 3.5 GHz, or even higher, whilst maintaining a small physical size. The physical size of the multiband antenna can be small enough to fit within a shark fin unit for an automobile, and may have a height (longitudinal length) that is less than about 55 mm.

The locations and/or dimensions of the gaps can be configured to provide the multiband antenna with two operable frequency bands, in use. The multiband antenna can be a single antenna that can have frequency bands of operation that enable signals in both cellular and wireless local area network (WLAN) frequencies to be received and transmitted.

The multiband antenna can be for transmitting and receiving signals from an automobile.

The feeding port may provide a single feed for a plurality of frequency bands. Such a single feed can significantly reduce the complexity and cost of the antenna.

The three conductive regions may be longitudinally spaced along the length of the substrate, and the first gap and second gap may extend in a generally lateral direction from a longitudinal edge of the substrate/conducting plate. Such an arrangement can enable certain operable frequency bands of interest to be provided, and can also provide for a compact layout of the antenna.

The first conductive region may be coupled to the second conductive region by a first coupling region. The second conductive region may be coupled to the third conductive region by a second coupling region. The first coupling region and second coupling region may be coupled together. The first coupling region and/or second coupling region may be broadly longitudinally aligned on the substrate. The first coupling region and/or second coupling region may be negligibly small. The first coupling region may be part of the first conductive region or the second conductive region. The second coupling region may be part of the second conductive region or the third conductive region.

The at least one conductive plate may be a single conductive plate. The first, second and third conductive regions may be joined along a longitudinal edge of the conductive plate. The longitudinal edge of the conductive plate by which the first, second and third conductive regions are joined may be on the other side of the substrate from which the lateral gaps extend.

The first gap may comprise a lateral section, a first longitudinal section, and a second longitudinal section. The first longitudinal section may extend from one end of the lateral section. The second longitudinal section may extend from the other end of the lateral section. A first gap having this structure can provide a frequency response of the antenna that is configurable by adjusting the location and/or dimension of the various sections of the gap. The presence of the different sections of the gap can affect the frequency response of the antenna, which can include an affect on the bandwidth of one or both frequency bands and/or the upper limits of one or both frequency bands and/or the lower limits of one or both frequency bands. A gap may be a non-electrically conductive region of the substrate that has edges that are defined by facing edges of the conductive regions. The non-electrically conductive regions may be achieved by not depositing conductive material on regions of the substrate, by providing a further coating on top of otherwise conductive materials or by cutting away, or otherwise removing, sections of the substrate.

The term non-electrically conductive may be understood herein to comprise insulating or poorly conductive materials, or materials designed to have such a high impedance at the frequency at which the antenna is to be operated as to generally act as an electronic barrier. Any material with impedance above approximately 1, 2, 5, or 10 kΩ per mm (1, 2, 5, 10 $M\Omega \cdot m^{-1}$) may be non-electrically conductive within the meaning used herein.

The second gap may comprise a lateral section and a longitudinal section. The longitudinal section may extend from one end of the lateral section. In a similar way to that described above in relation to the first gap, the presence of the different sections of the second gap can affect the frequency response of the antenna.

The other end of the lateral section of the second gap may open up into a non-electrically conducting region on one side of the substrate of the antenna, which may be referred to as an open region. The second longitudinal section or the lateral section of the first gap may open up into a non-electrically conducting region on one side of the substrate of the antenna.

The open region may be a longitudinally extending region against an edge of the substrate in which no conducting plate is present.

The open region can enable the gaps to be in the form of open gaps. An open gap may allow the resonant frequency of the antenna to be related to one quarter of the wavelength of the required frequency. The open region may be a region of the substrate that has not been coated in conductive material. The gap may also be a region where the substrate has been cut away, or otherwise removed. The open region differs from the gaps of some embodiments in that their edges are not defined by two facing edges of the conductive regions.

The first longitudinal section of the first gap can extends towards, but not reach, the longitudinal section of the second gap.

The antenna may further comprise a ground plane, and the third conductive region may be coupled to the ground plane. The third conductive region may be coupled to the ground plane across substantially all of the lateral width of the third conductive region. In this way the current density between the feeding port and the ground plane is reduced as it is spread over the lateral width of the third conductive region. This has the effect of increasing the bandwidth of the antenna.

The substrate may extend in a direction that is substantially perpendicular to the ground plane. This can provide a convenient structure of the antenna that is suitable for fitting within a shark fin unit. In some examples the rooftop of the automobile may be considered as an extension of the ground plane.

The feeding port may comprise a signal terminal and a ground terminal. The signal terminal of the feeding port may be situated on the second conductive plate. The signal terminal of the feeding port may be configured to be connected to a first connecting element for conducting transmit and receive signals. The first connecting element may be an inner conductor of a coaxial cable, a wire, a separate circuit board terminal or any other suitable conductive medium. The ground terminal of the feeding port may be situated on the third conductive plate. The ground terminal of the feeding port may be configured to be connected to a second connecting element. The second connecting element may be a conducting shield of a coaxial cable, a wire, a separate circuit board terminal or any other suitable conductive medium. Alternatively the conducting shield of the coaxial cable may be connected directly to a ground plane to which the antenna is coupled.

The feeding port may be configured such that the signal terminal and the ground terminal are proximal to one another. The feeding port may be configured such that the signal terminal may be located proximal to an edge of the second conductive region and the ground terminal may be located proximal to a facing edge of the third conductive plate.

The at least one conductive plate may be provided on a single side of the substrate.

The antenna may be shaped so as to fit within a shark fin unit, for example, an edge of the antenna that is distal from the ground plane may be sloped so that it corresponds to the internal shape of the shark fin unit. The maximum height of the antenna may be less than 55 mm in order to fit within the shark fin unit. It may not be possible to manufacture prior art antennas that have a suitable frequency response for the frequency bands of interest that is capable of fitting within known shark fin units.

There may be provided a shark fin unit comprising any multiband antenna disclosed herein.

There may be provided an automobile, such as a car, fitted with any multiband antenna or shark fin unit disclosed herein.

A description is now given, by way of example only, with reference to the accompanying drawings, in which:

FIG. 1 shows a shark fin antenna unit;

FIGS. 2*a* and 2*b* illustrate a multiband antenna according to an embodiment of the invention;

One or more embodiments of the invention relate to a multiband antenna consisting of at least one conductive plate on a substrate. The conductive plate defines a first conductive region, a second conductive region and a third conductive region, whereby a first gap is located between the first conductive region and the second conductive region; and a second gap is located between the second conductive region and the third conductive region. The provision of the regions and gaps in this way enables a compact multiband antenna that can operate well at frequency bands between about 0.5 GHz and 3.5 GHz (or even higher) to be provided. In particular, it can be possible to achieve a multiband antenna that can fit within a known shark fin unit for an automobile, whereby the multiband antenna can receive and transmit signals with a wide range of frequencies.

Such a multiband antenna can include a feeding port that provides an electrical connection between the second conductive region and the third conductive region across the second gap, and is configured to conduct signals that are received at, or transmitted from, the antenna.

Today there is a strong drive towards "green driving" that has resulted in several projects concerning "intelligent driving". New communication systems that are able to communicate between cars (car2car) and between a car and the roadside are in a definition phase. As yet there is no uniform global standard, but it is expected that the majority of such systems will work in the 5.8 to 6 GHz band.

Multiple antennas will need to be packed together in a small volume and positioned on the roof tops of vehicles in so called "antenna units". It has been found that for car2car communication at least two known antennas are required in order to combat multipath fading and to cope with the different relative directions of the cars. Multiple coaxial cables are required to connect the antennas to electronic devices. These cables pose a major cost burden. It is also expected that in future more electronic components will be positioned close to the antenna, in which case many of these expensive cables can be omitted.

Cellular communication is performed in several different frequency bands in different territories. In Europe the frequency bands below are currently used:

GSM 900: 880-960 MHz

GSM 1800: 1710-1880 MHz

UMTS: 1920-2170 MHz other frequency bands are foreseen for future use.

Cellular communication in the USA currently uses the frequency bands described below:

GSM 850: 824-894 MHz

PCS: 1850-1990 MHz other frequency bands are foreseen for future use.

Other systems that may be used with intelligent driving are:

GPS: 1575.42±1.023 MHz

WLAN 5.9: 5875-5905 MHz

WLAN 2.4: 2404-2489 MHz

Figure 1:
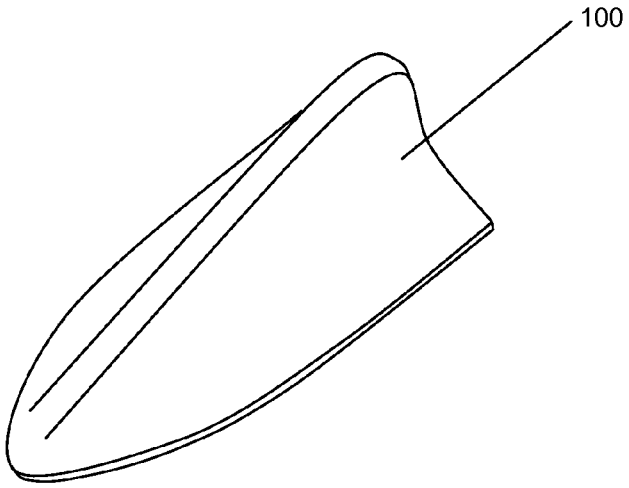

FIG. 1 shows a typical shark fin antenna unit 100 that may be placed at the rear of the rooftop of a vehicle. Antennas inside the antenna unit 100 are restricted in dimensions and the antennas have to be adapted to fit the unit 100. The antenna unit 100 also has stringent requirements for weather protection, shock behaviour and sensitivity to rises in temperature. The antenna unit 100 is encapsulated by a plastic randome.

Typical dimensions of the antenna unit 100 are:

maximum height of 50 to 55 mm (external randome height of 60 mm);

length of 120 mm (external randome length of 140 mm); and width of 40 mm (external randome width of 50 mm).

There is a fundamental relationship between the signal frequency required and the size of the antenna. A single resonant antenna element is proportional to the wavelength of the signal frequency to be received or transmitted. This means the higher the frequency of operation is, the smaller the antenna becomes. However, where a fixed frequency requirement exists, limiting the size of a prior art antenna so as to conform its dimensions to that of a standard housing has the effect of reducing its operational efficiency.

A resonant quarter wave monopole antenna (length=0.25 λ) is a typical antenna that can be used above a rooftop of a vehicle or above a ground plane. The GSM900 standard defines the lowest frequency band of the communications standards in use today in Europe, and requires a resonant quarter wavelength monopole antenna length of 77 mm. For communication at 700 MHz an antenna length of 87 mm length is required. Both lengths are too long to be implemented in a standard "shark fin" unit. Reduction in size is required, but this will reduce the important property of the fractional bandwidth that is attainable with known monopole antennas. The fractional bandwidth (as a percentage) is defined as:

$$B_F = \frac{f_2 - f_1}{\sqrt{f_1 f_2}} \times 100$$

where $f_1$ and $f_2$ are the lower and upper frequencies of the frequency band, respectively.

$f_1$ and $f_2$ may be measured, for example, at a reference level of return loss of −10 dB. The return loss is the loss of signal at the antenna due to poorly matched impedance of the antenna and the line that feeds it; it is the loss due to reflected signal. The return loss is a parameter commonly used to define the quality of matching of the radio frequency signal to the antenna.

In addition, reducing the size of known quarter wave monopole antennas results in a reduction of the radiation resistance. For example reducing the size to 50% (that is, ⅛λ) reduces the radiation resistance to 8 ohms for a certain length/width ratio of the antenna. This leads to increased return loss and thus sub-optimal matching of the antenna to the radio.

Figure 2A:
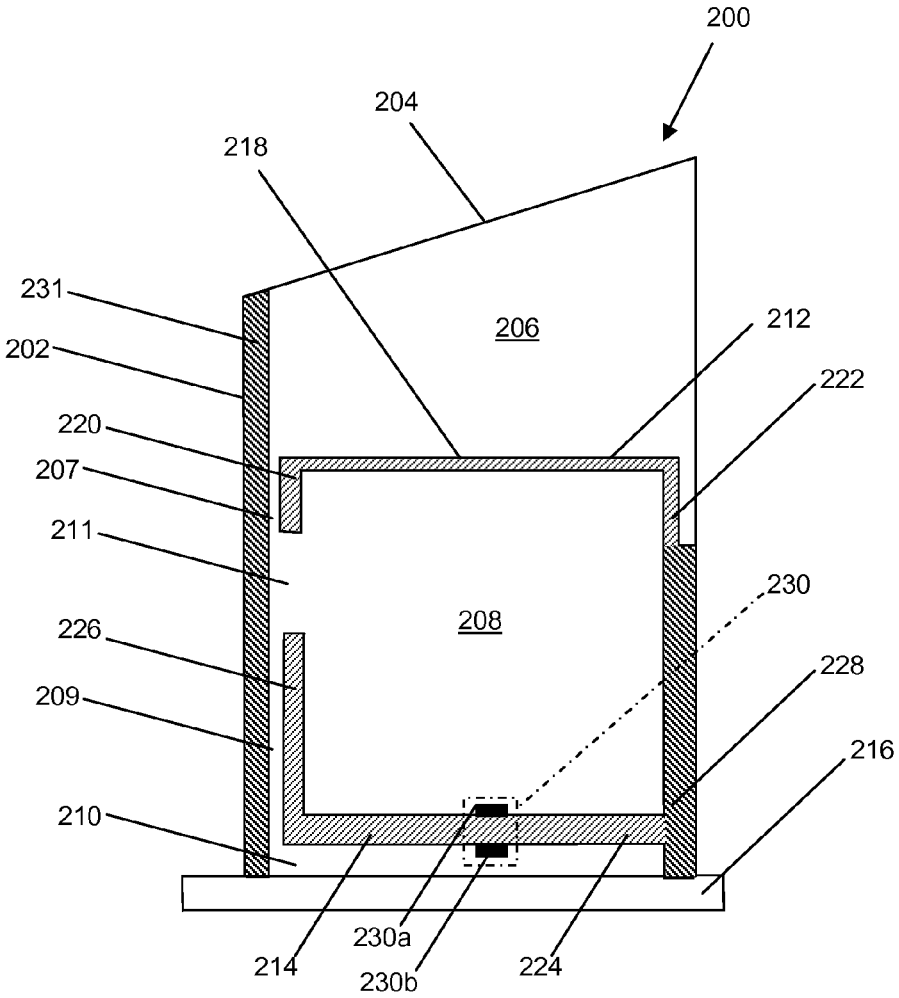
Figure 2B:
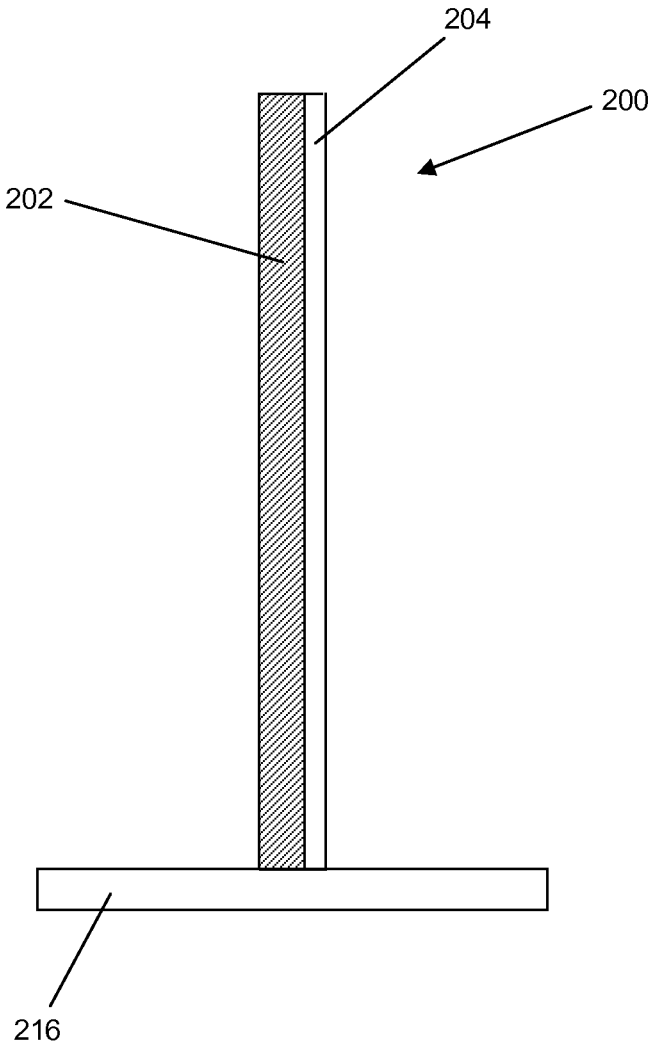

FIG. 2*a* shows a front view of a multiband antenna 200 according to an embodiment of the invention, and FIG. 2*b* shows a side view of the same antenna 200. The antenna 200 has a substrate 202. At least one conductive plate 204 is located on the substrate 202 to define a first conductive region 206, a second conductive region 208 and a third conductive region 210.

In order to separate the conductive regions, a first gap 212 is located between the first conductive region 206 and the second conductive region 208, and a second gap 214 is located between the second conductive region 208 and the third conductive region 210. In this example, the first, second and third conductive regions 206, 208, 210 are spaced apart in a longitudinal direction of the antenna 200, and the first and second gaps 212, 214 generally run in a lateral direction. The edges of the gaps are defined by the facing edges of the conductive regions. The gaps 212, 214 may also be referred to as slots. The first gap 212 is located further away from the ground plane 216 than the second gap 214.

Both the first gap 212 and the second gap 214 open into an open region 228 on one side of the antenna. Having open gaps allows the antenna to operate efficiently as a resonant quarter wavelength monopole antenna.

The open region 228 in this example is a region of the substrate that, like the gaps 212, 214, has not been coated in conductive material. The open region 228 differs from the gaps in this example in that its edges are not defined by two facing edges of the conductive regions 206, 208, 210.

In this example, the first, second and third conductive regions 206, 208, 210 of the conductive plate 204 are joined along a longitudinal edge 231 of the conductive plate 204. The first conductive regions 206 is coupled to the second conductive region 208 by a first coupling region 207, and the second conductive region 208 is coupled to the third conductive region 210 by a second coupling region 209. In the example shown in FIG. 2*a* these first and second coupling regions extend longitudinally on the substrate. The longitudinal edge 231 of the conductive plate by which the first, second and third conductive regions 206, 208, 210 are joined may be on the other side of the substrate 202 from which the gaps 212, 214 extend.

The embodiment of FIGS. 2*a* and 2*b* show a single conductive plate 204 on a single surface of the substrate 202, and this can provide for convenient and cost effective manufacture. However, in other embodiments, the necessary conductive regions can be made up of one or more conductive plates on one or both sides of the substrate (possibly using vias to electrically connect conductive plates on opposite sides of the substrate 202) in order to provide an antenna with the functionality described herein.

The substrate 202 can be a printed circuit board (PCB) material such as FR4, or any dielectric material that has sufficient performance for the frequency bands of operation. The substrate 202 can be low cost both in terms of material and manufacturing as existing technologies for printed circuit boards can be used to provide for the conductive regions 206, 208, 210 on the substrate 202. The conducting regions 206, 208, 210 (which may also be referred to as conducting surfaces) can be copper or any other material that has sufficient performance for the frequency bands of operation. The conducting regions 206, 208, 210 can be very thin, for example 35 micrometers. In some examples, the conducting regions 206, 208, 210 can be covered by a protective layer to prevent or reduce oxidation of the conductive regions 206, 208, 210 and/or to reduce degradation due to temperature. Such requirements may be beneficial in order for the antenna 200 to satisfy automotive requirements.

The third conductive region 210 of the conducting plate 204 is connected to a ground plane 216, in this embodiment across the entire lateral width of the third conductive region 210. In this way the conducting plate 204 can be considered as an extension of the ground plane 216. The ground plane 216 can be an electrically conductive bottom surface of a shark fin module, which in turn can be considered as an extension of the car roof to which the shark fin is attached in use. Therefore, the ground plane 216 can be considered as a very large grounding body when the antenna 200 is situated in use on a car roof.

The shape at the top side of the antenna 200 in this example is adapted to fit the shape of a shark fin module.

The substrate 202 and conducting plate 204 are substantially perpendicular to the ground plane 216, and are vertical in a typical in-use position on the roof of a car.

The first gap 212 comprises a laterally extending section 218 (which is horizontal in use) and two longitudinally extending sections 220, 222 (which are vertical in use). A first longitudinal section 220 extends from one end of the lateral section 218 and a second longitudinal section 220 extends from the other end of the lateral section 218.

The second gap 214 comprises a laterally extending section 224 (which is horizontal in use) and a longitudinally extending section 226 (which is vertical in use). The longitudinal section 220 extends from one end of the lateral section 218. The other end of the lateral section 224 opens up into an open region 228 on one side of the antenna 200.

Partway along the lateral section 224 of the second gap 214 is a "feeding port" 230. The feeding port 230 is a location on the substrate that may be mounted with a socket to which an external electrical connection can be made. In use, a coaxial cable (not shown) is connected to the feeding port 230 in order to send signals to, and receive signals from, the antenna 200. The feeding port 230 has two terminals. A signal terminal 230*a* of the feeding port 230 is situated on the second conductive region 208. During use, an inner conductor of the coaxial cable can be coupled directly to the second region 208 via the signal terminal 230*a* of the feeding port 230. A ground terminal 230*b* of the feeding port 230 is located on the third conductive region 210. During use, a conducting shield of the coaxial cable can be coupled to the third conductive region 210 via the ground terminal 230*b* of the feeding port 230. The third conductive region 210 is also coupled to the ground plane 216.

In this example, the feeding port 230 is configured such that the signal terminal 230*a* and the ground terminal 230*b* are proximal to one another either side of the second gap 214. Specifically, the signal terminal 230*a* and ground terminal 230*b* are situated so as to face one another on the edges of their respective conductive regions.

In this example, the feeding port 230 is located about halfway along the lateral section 224 of the second gap 214. The precise location of the feeding port 230 along the lateral section 224 can have an affect on the frequency response of the antenna, and can be located during design in order to fine tune the performance of the antenna 200.

The lowest operating frequency that can be received at/transmitted from the antenna 200 is defined by the height of the antenna 200. Inclusion of the first slot 218 enables a much lower operating frequency to be achievable than would otherwise be possible.

The antenna 200 of FIG. 2 enables adequate transmission and reception of signals at two main frequency bands; a lower frequency band and a higher frequency band. "Adequate transmission" can be considered as providing a return loss of less than −10 dB. The lower frequency band can be suitable for at least one communication standard, such as GSM900. The higher frequency band can be suitable for many existing communication standards and for expected future standards, such as WLAN communications. The length of the gaps 212, 214 in this embodiment can be set so as to align the lower band edges of both frequency bands, as will now be described in more detail.

The length of the first longitudinal section 220 of the first slot 212 affects the lower limit of both the higher frequency band and the lower frequency band. If the length of the first longitudinal section 220 is reduced then the lower limits of the higher frequency band and the lower frequency band are increased, although not necessarily by the same amount. That is, the lower limit of the higher frequency band may increase faster than the lower limit of the lower frequency band increases, or vice versa.

The length of the second longitudinal section 222 of the first slot 212 mainly affects the lower limit of the higher frequency band. If the length of the second longitudinal section 222 is reduced then the lower limit of the higher frequency band is increased.

The length of the longitudinal section 226 of the second slot 214 mainly affects the bandwidth of the higher frequency band. If the length of the longitudinal section 226 is reduced then the bandwidth of the higher frequency band is increased.

The width of the lateral section 218 of the first gap 212 influences the lower limit of both the higher frequency band and the lower frequency band. However, this influence can be different to the influence provided by the length of the first longitudinal section 220 (discussed above), and therefore the gap 212 can be designed with values for the width of the lateral section 218 and the first longitudinal section 220 such that the lower limits of the two frequency bands can be adjusted independently.

The width of the lateral section 224 of the second gap 214 influences the bandwidth of the higher frequency band, and can affect the upper limit of the higher frequency band.

As will be appreciated from the above description of how the dimensions of the gaps 212, 214 affect the frequency response of the antenna 200, it is possible to align the frequency bands according to required specifications.

It is apparent that it is the gaps 212, 214 that can be used to define the band edges of the frequency bands, because of this the band edges are less affected by the properties of the material from which the conducting regions are constructed, which can be strongly influenced by the environment. This is an interesting concept as it can enable the antenna 200 to be much more resistant to detuning from nearby objects or other antennas, when compared with known antennas. This can be particularly advantageous in the confined space of a shark fin unit where a number of antennas may be located closely together.

It will be appreciated that in other embodiments the gaps 212, 214 do not need to consist of straight sections, nor do they necessarily require more than one section extending in different directions.

In some examples of the antenna disclosed herein, the dimensions of the second gap 214 can be considered as providing control over the input impedance of the antenna 200, such that the bandwidth of the frequency bands of interest can be set accordingly.

Figure 3:
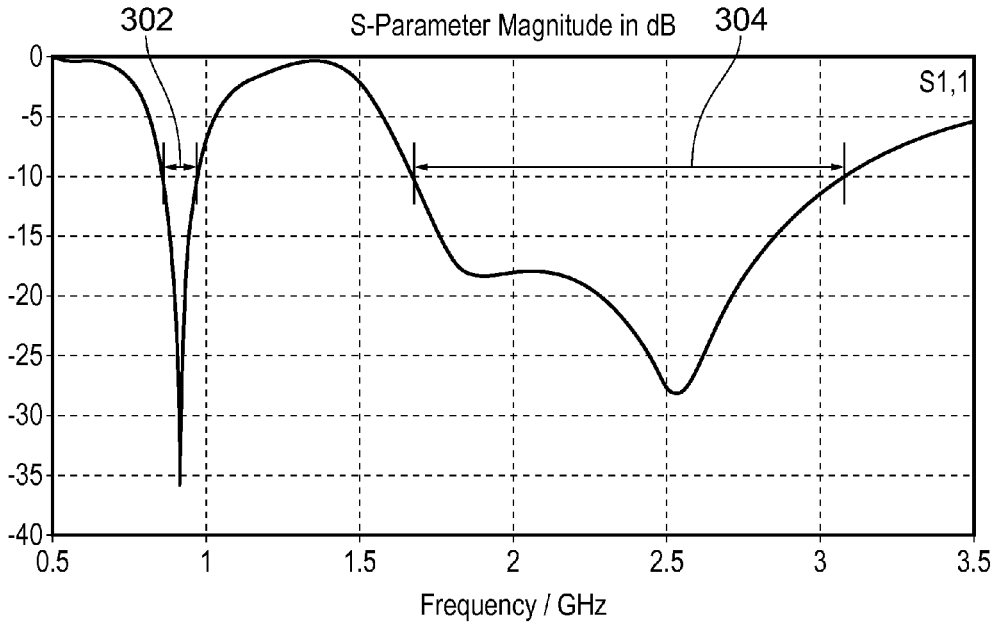
FIG. 3 shows graphically the simulated return loss in decibels of the antenna of FIG. 2.

FIG. 3 shows graphically the simulated return loss in decibels of the antenna of FIG. 2. The simulations are performed with industry leading 3-dimensional electromagnetic simulators such as HFSS from Ansoft Corporation or Microwave Studio from CST Darmstadt Germany.

It can be seen from FIG. 3 that a lower frequency band 302 and a higher frequency band 304 are provided, whereby a frequency band is defined as a range frequencies with a return loss of less than −10 dB, which is the standard for acceptable RF performance in vehicle mounted antennas, can be seen in this graph. In some embodiments, the higher frequency band 304 can be very wide and can potentially accommodate communication according to a number of standards that fall within the band.

Figure 4:
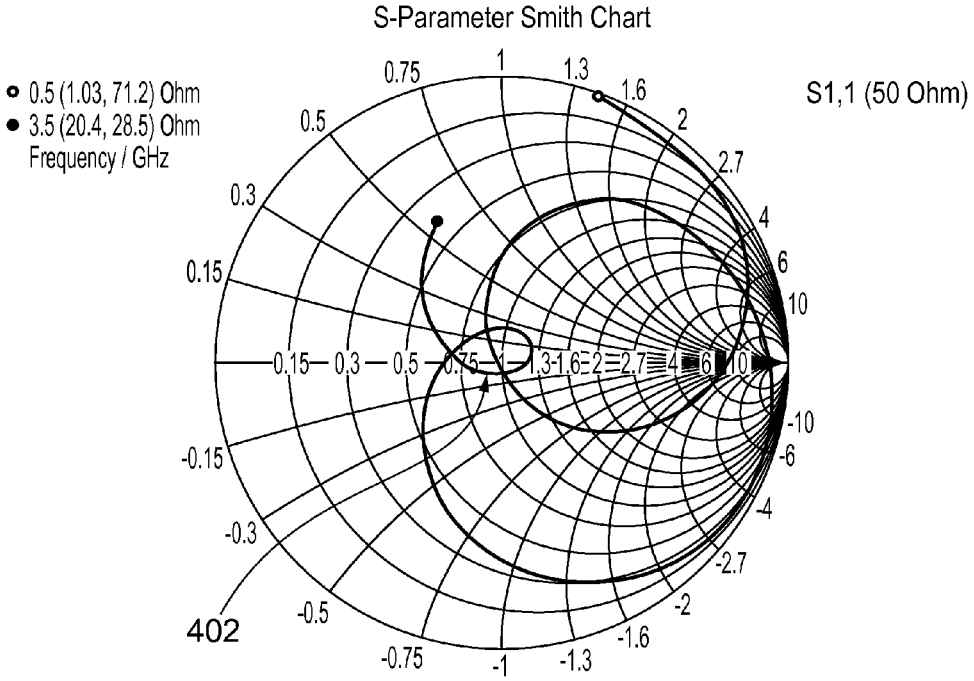
FIG. 4 illustrates graphically the performance of the antenna of FIG. 2 on a Smith chart.

FIG. 4 illustrates graphically the performance of the antenna of FIG. 2 on a Smith chart. The Smith chart is a commonly used method of displaying complex information related to the impedance performance of an antenna. The circumferential axis shows the reactive coefficient of the antenna relative to a reference level of 50Ω. The horizontal linear axis shows the resistive coefficient relative to this reference level. The function plotted on the graph shows the two components of the impedance of the antenna at different frequencies, with the frequency increasing as the function traces a clockwise motion.

FIG. 4 illustrates that the higher frequency band is double tuned due to the loop 402 in the function near the end of the clockwise trace. Double tuning is a known technique to enlarge a fractional bandwidth, and is usually accomplished by adding discrete components to the antenna feeding port. Such external discrete components are designed and selected in order to compensate for the reactance of the input impedance across a certain frequency band thereby increasing the range of frequencies that the return loss is considered acceptable (for example a return loss less than −10 dB).

Figure 5:
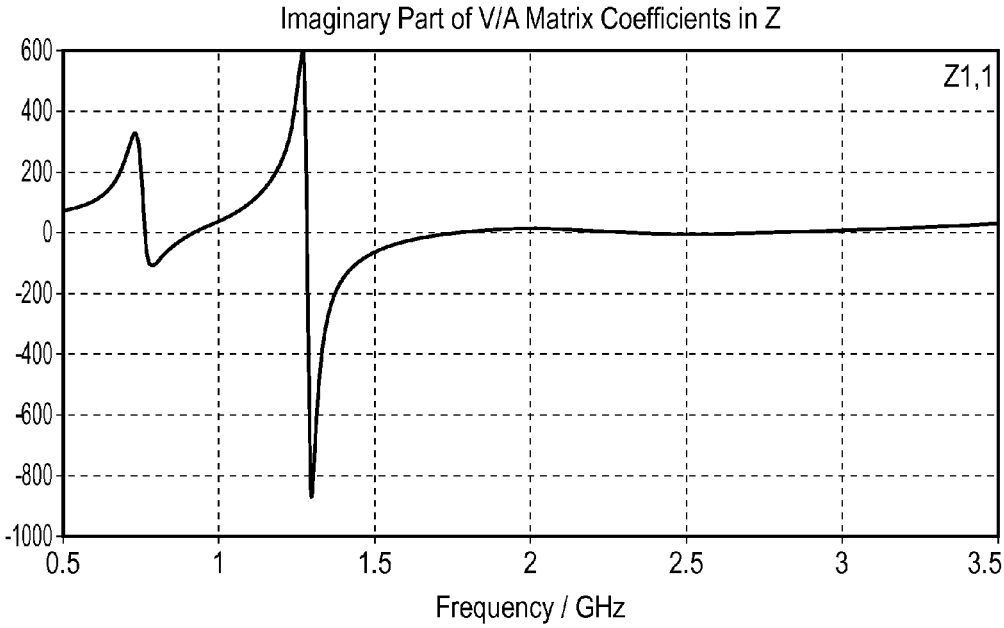
FIG. 5 shows the imaginary data from the Smith chart of FIG. 4 and represents the simulated input reactance.
Figure 6:
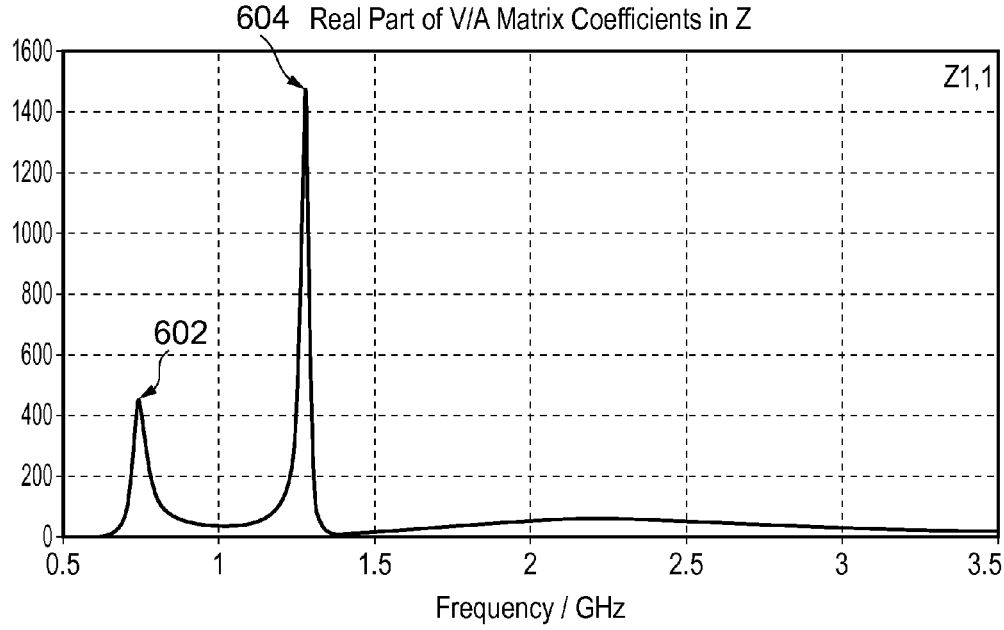
FIG. 6 shows the real data from the Smith chart of FIG. 4 and represents the input resistance.

FIGS. 5 and 6 each show some of the information from the Smith chart of FIG. 4 in a more readily understandable way. FIG. 5 shows the imaginary data from the Smith chart and represents the simulated input reactance in ohms. FIG. 6 shows the real data from the Smith chart of FIG. 4 and represents the input resistance in ohms.

The reactance compensation in the high frequency band is particularly noticeable from FIG. 5 where the reactance is close to zero for frequencies in excess of about 1.5 GHz.

Two anti-resonant frequencies 602, 604 that are located above and below the band edges of the lower frequency band can be clearly seen in FIG. 6. Relatively constant input resistance between the two anti-resonant frequencies 602, 604 of about 50Ω is also visible from FIG. 6, and this represents a good and consistent performance in the lower frequency band. The stable 50Ω resistance allows the antenna to be well impedance matched with radio circuitry, ensuring that the antenna can perform efficiently.

Figure 7:
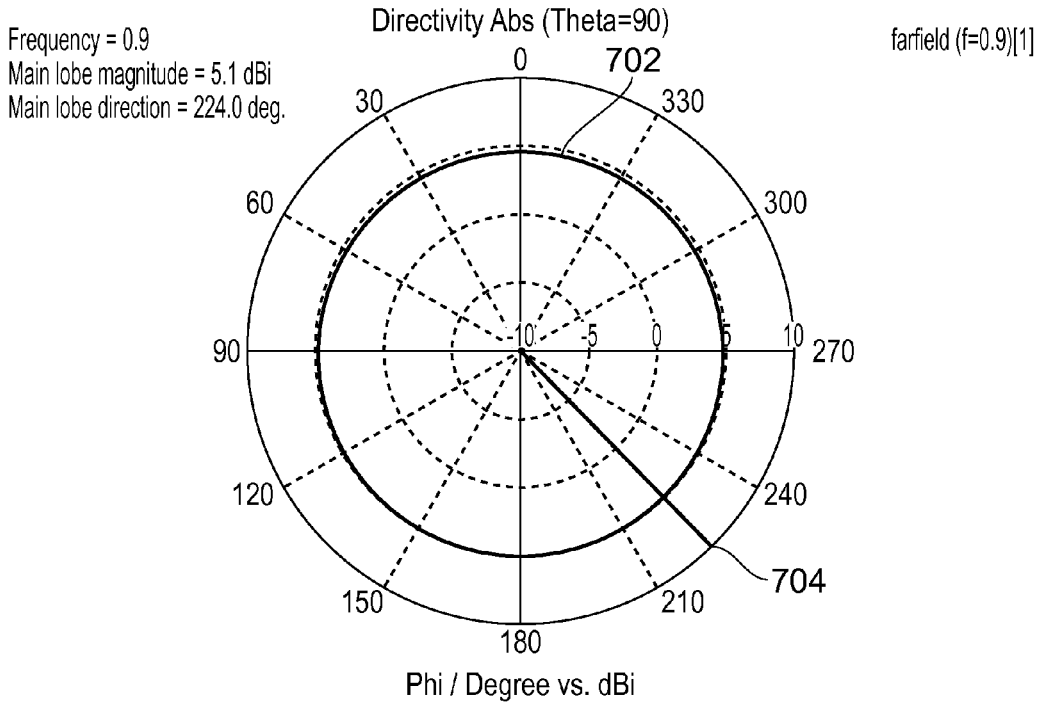
FIG. 7 illustrates graphically the simulated directivity of the antenna of FIG. 2 at a frequency of operation of 900 MHz.
Figure 8:
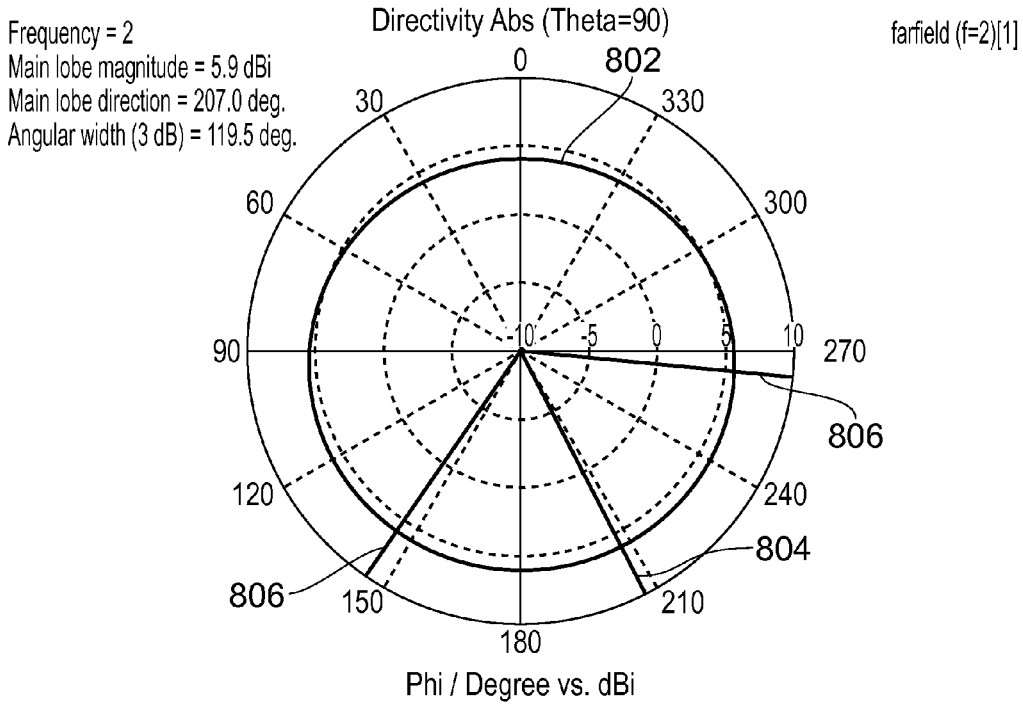
FIG. 8 illustrates graphically the simulated directivity of the antenna of FIG. 2 at a frequency of operation of 2 GHz.

FIG. 7 illustrates graphically the simulated directivity (dbi) of the antenna of FIG. 2 in a horizontal plane at a frequency of operation of 900 MHz, which is in the lower frequency band. FIG. 8 illustrates graphically the simulated directivity (dbi) of the antenna of FIG. 2 in a horizontal plane at a frequency of operation of 2 GHz, which is in the higher frequency band.

Both FIGS. 7 and 8 illustrate that the antenna is highly omnidirectional when operating in both frequency bands.

FIG. 7 shows that the gain 702 (which is shown on the radial axis) is almost constant at 5 dBi for all directions at 900 MHz. The main lobe direction 704 at 900 MHz is at an angle of 224 degrees, and the antenna can be considered as having a 360 degree angular width at which the ripple in the gain is less than 3 dB.

FIG. 8 shows that the gain 802 is consistently near 5 dBi for all directions at 2 GHz, although is not quite as consistent as for 900 MHz as shown in FIG. 7. Nonetheless, the omnidirectionality can be considered to be very good when compared with prior art antennas operating at such high frequencies. The main lobe direction 804 at 2 GHz is at an angle of 207 degrees, and the antenna can be considered as having a 119.5 degree angular width at which the ripple in the gain is less than 3 dB. The boundaries of the angular width are illustrated in FIG. 8 with references 806.

It will be appreciated that good omnidirectionality can be an important consideration in vehicle antennas, where the vehicle, and hence the antenna, will consistently change direction.

Figure 9:
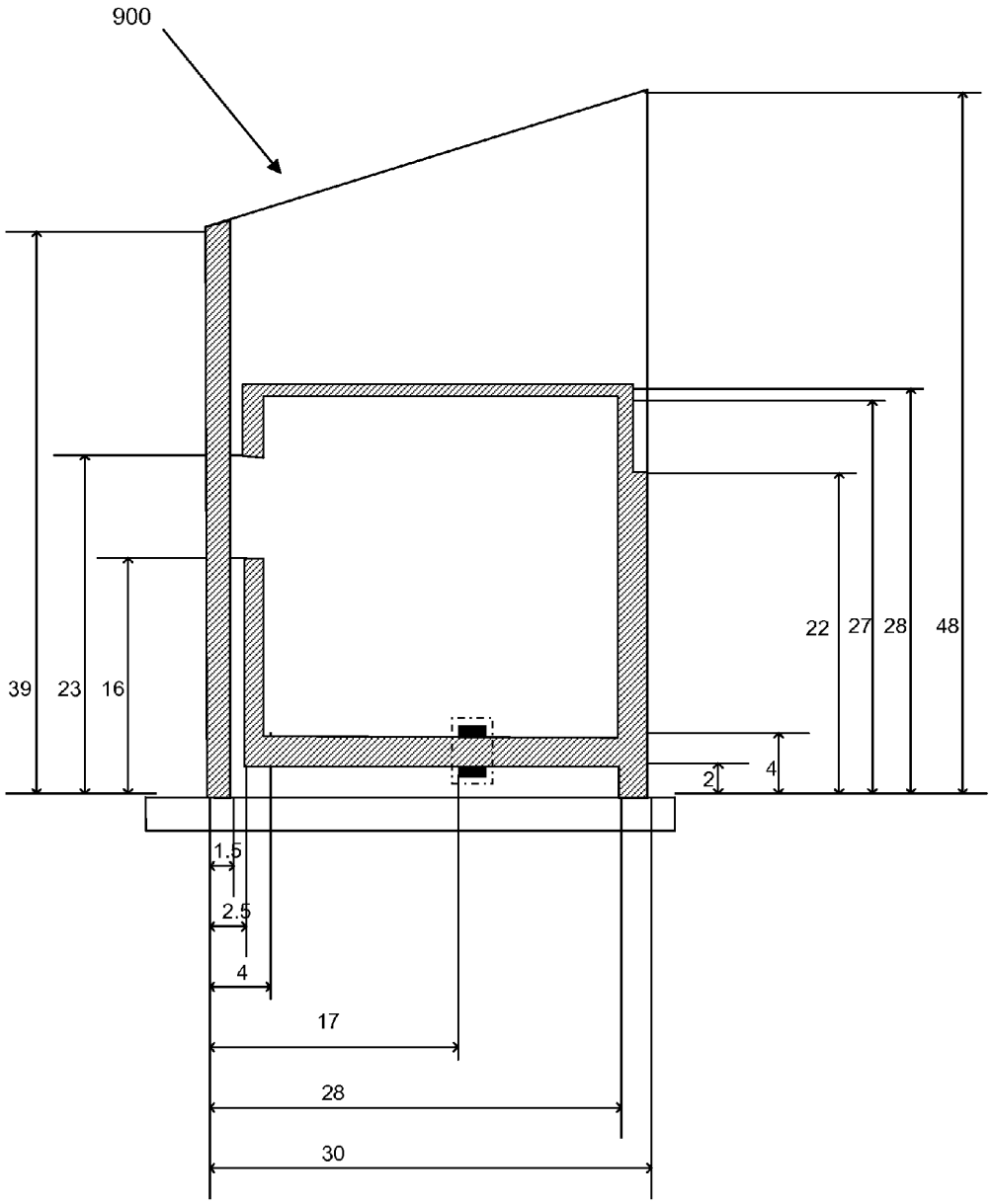
FIG. 9 illustrates example dimensions (in mm) of a multiband antenna according to an embodiment of the invention.

FIG. 9 illustrates example dimensions (in mm) of a multiband antenna 900 according to an embodiment of the invention. The substrate material used is a low cost FR4 printed circuit board material with a thickness of 1.6 mm, and a dielectric constant of 4.4.

It can be seen from FIG. 9 that the total height of the antenna 900 is less than 50 mm, which makes it suitable for fitting inside a typical shark fin unit. Also, the top of the antenna 900 is shaped to fit in a protective randome.

Figure 10:
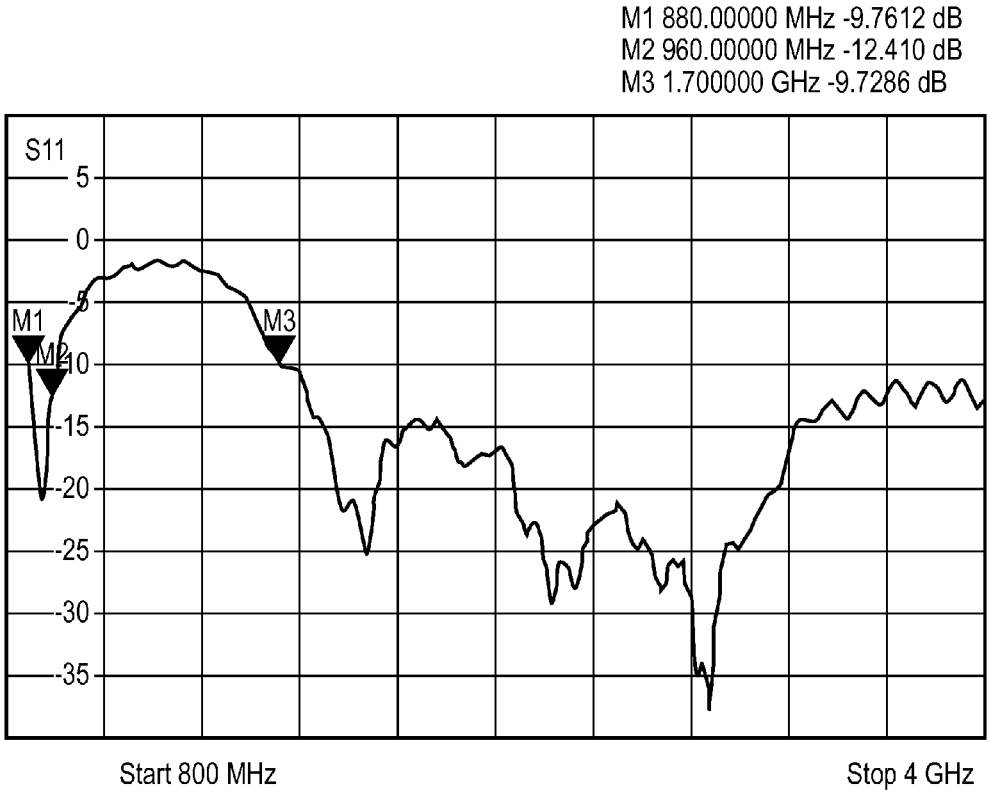
FIG. 10 shows the measured return loss for the manufactured model of FIG. 9.

FIG. 10 shows the measured return loss (db) for the manufactured model of FIG. 9. The antenna is measured on a ground plane of 1 square meter, and is placed in a protective randome of ABS material.

It can be seen from FIG. 10 that the following frequency bands are measured with a return loss limit of −10 db:

lower band: 880 to 960 MHz; and higher band: 1.7 to greater than 4 GHz.

Therefore, the multiband antenna of FIG. 9, with a reduced size when compared with the prior art, can be used for several standards like:

GSM 900: 880-960 MHz;

GSM 1800: 1710-1880 MHz;

UMTS: 1920-2170 MHz;

GSM 850: 824-894 MHz;

PCS: 1850-1990 MHz;

WLAN 2.4: 2404-2489 MHz; and and other future standards operating to at least 4 GHz.

It has been found experimentally that the antenna of FIG. 9 can provide an efficiency of 82% for both frequency bands of interest, and this can be considered as a very good implementation of a multiband antenna.

It will be appreciated that the antenna model of FIG. 9 is only an example of an embodiment of the invention, that the dimensions illustrated are not to be considered as limiting, and that the antenna can be designed to be suitable for other frequency bands.

One or more embodiments disclosed herein can be considered as relating to a multiband vehicle antenna that forms a conductive extension of the rooftop or other ground plane, and contains two open gaps/slots to create multiband operation with reduced size. The antenna can be produced on a single sided low cost substrate material and can be relative resistant to detuning due to nearby objects or other antennas. This can be especially advantageous if the antenna is to be located on close to proximity with other antennas, for example if more than one antenna is located in a shark fin.

It will be appreciated that because at least some of the operational parameters of embodiments of the antenna are set by the location and/or dimensions of gaps, and not solely on conductive regions, then the detuning effect due to nearby conductors can have a reduced effect as they do not directly change the characteristics of the gaps.

Embodiments of the antenna disclosed herein can be designed independently of the electronics to which the antenna will be connected. RF integrated circuits can be positioned below embodiments of the antenna in order to eliminate or reduce the need for coaxial cables.

The invention claimed is:

1. A multiband antenna comprising:

a substrate having a lateral direction and a longitudinal direction;

at least one conductive plate on the substrate that defines a first conductive region, a second conductive region, and a third conductive region, wherein the first, second, and third conductive regions are configured so as to define:

a first gap between the first conductive region and the second conductive region, the first gap having a first open end and a first closed end; and a second gap between the second conductive region and the third conductive region, the second gap having a second open end and a second closed end, wherein the first closed end of the first gap directly faces the second closed end of the second gap;

a feeding port comprising a signal terminal, wherein the signal terminal is configured to couple the second conductive region to a first connecting element that is configured to conduct transmit or receive signals.

2. The multiband antenna of claim 1, wherein the three conductive regions are longitudinally spaced along a length of the substrate.

3. The multiband antenna of claim 2, wherein the first gap and the second gap extend in a generally lateral direction from a longitudinal edge of the substrate.

4. The multiband antenna of claim 1, wherein the at least one conductive plate is a single conductive plate, the first conductive region is coupled to the second conductive region by a first coupling region, and the second conductive region is coupled to the third conductive region by a second coupling region.

5. The multiband antenna of claim 1, wherein the first gap comprises:

a lateral section;

a first longitudinal section; and a second longitudinal section, wherein the first longitudinal section extends from a first end of the lateral section, and the second longitudinal section extends from a second end of the lateral section.

6. The multiband antenna of claim 5, wherein the second longitudinal section opens up into a non-electrically conducting region on one side of the multiband antenna.

7. The multiband antenna of claim 1, wherein the second gap comprises:

a lateral section; and a longitudinal section, wherein the longitudinal section extends from a first end of the lateral section.

8. The multiband antenna of claim 7, wherein a second end of the lateral section opens up into an non-electrically conducting region on one side of the multiband antenna.

9. The multiband antenna of claim 7, wherein a first longitudinal section of the first gap extends towards, but does not reach, the longitudinal section of the second gap.

10. The multiband antenna of claim 7, wherein the feeding port is located about halfway along the lateral section of the second.

11. The multiband antenna of claim 1, wherein the first connecting element is an inner conductor of a coaxial cable, and the feeding port further comprises a ground terminal configured to couple the third conductive region to a shielding conductor of the coaxial cable.

12. The multiband antenna of claim 11, wherein the signal terminal and the ground terminal face one another from respective edges of the second conductive region and the third conductive region.

13. The multiband antenna of claim 1, further comprising:

a ground plane, wherein the third conductive region is coupled to the ground plane.

14. The multiband antenna of claim 13, wherein the third conductive region is coupled to the ground plane across substantially all of a lateral width of the third conductive region.

15. The multiband antenna of claim 13, wherein the substrate extends in a direction that is substantially perpendicular to the ground plane.

16. The multiband antenna of claim 13, wherein the ground plane is configured to be connected to a conducting shield of a coaxial cable.

17. The multiband antenna of claim 13, wherein the ground plane is an extension of a car roof.

18. The multiband antenna of claim 1, wherein the at least one conductive plate is provided on a single side of the substrate.

19. The multiband antenna of claim 1, wherein the open ends of the first and second gaps are substantially on one lateral side of the substrate.

20. The multiband antenna of claim 19, wherein the closed ends of the first and second gaps are substantially on another lateral side of the substrate.

* * * * *